US006615426B1

(12) United States Patent
Risk, Jr.

(10) Patent No.: US 6,615,426 B1
(45) Date of Patent: Sep. 9, 2003

(54) SIDERAIL PAD FOR HOSPITAL BED

(75) Inventor: James Robert Risk, Jr., Milan, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 09/687,715

(22) Filed: Oct. 13, 2000

Related U.S. Application Data

(60) Provisional application No. 60/159,803, filed on Oct. 15, 1999.

(51) Int. Cl.[7] ..... A47C 21/08
(52) U.S. Cl. ..... 5/425; 5/663; 5/428; 5/430
(58) Field of Search ..... 5/425–430, 663

(56) References Cited

U.S. PATENT DOCUMENTS

| | | | |
|---|---|---|---|
| 421,656 | A | 2/1890 | Blanken |
| 993,119 | A | 5/1911 | Stannard |
| 2,254,466 | A | 9/1941 | Albert |
| 2,644,173 | A | 7/1953 | James |
| 2,710,976 | A | 6/1955 | Martensen |
| 3,018,492 | A | 1/1962 | Rosen |
| 3,148,387 | A | 9/1964 | Sarnier, Jr. et al. |
| 3,266,545 | A | 8/1966 | Kruissink |
| 3,321,779 | A | 5/1967 | Kaufman et al. |
| 3,610,685 | A | 10/1971 | Lay |
| 3,619,824 | A | 11/1971 | Doyle |
| 3,742,530 | A | 7/1973 | Clark |
| 3,877,090 | A | 4/1975 | Schutz |
| 4,214,326 | A | 7/1980 | Spann |
| 4,215,446 | A | 8/1980 | Mahoney |
| 4,232,415 | A | 11/1980 | Webber |
| 4,370,765 | A | 2/1983 | Webber |
| D276,112 | S | 10/1984 | Ferrell et al. |
| 4,484,367 | A | 11/1984 | Jenkins |
| 4,607,402 | A | 8/1986 | Pollard |

(List continued on next page.)

FOREIGN PATENT DOCUMENTS

| | | | |
|---|---|---|---|
| GB | 2 267 430 | A | 8/1993 |

OTHER PUBLICATIONS

A Hill–Rom Solution, "Med–Surg Bed Accessories" 1997.

*Primary Examiner*—Michael F. Trettel
(74) *Attorney, Agent, or Firm*—Bose McKinney & Evans LLP

(57) ABSTRACT

In accordance with the present disclosure, a siderail apparatus for a siderail of a hospital bed is provided that is configured to be coupled to the siderail. Preferably, the siderail apparatus is padded.

48 Claims, 10 Drawing Sheets

U.S. PATENT DOCUMENTS 4,654,903 A 4/1987 Chubb et al.
4,670,923 A 6/1987 Gabriel et al.
4,672,698 A 6/1987 Sands
4,710,049 A 12/1987 Chang
4,710,992 A 12/1987 Falwell et al.
4,767,419 A 8/1988 Fattore
4,783,864 A 11/1988 Turner
4,800,600 A 1/1989 Baum
4,827,545 A 5/1989 Arp
4,872,228 A 10/1989 Bishop
4,873,734 A 10/1989 Pollard
4,941,221 A 7/1990 Kanzler
5,010,611 A 4/1991 Mallett
5,035,014 A 7/1991 Blanchard
5,044,025 A 9/1991 Hunsinger et al.
5,077,843 A 1/1992 Dale et al.
5,083,332 A 1/1992 Foster et al.
5,097,550 A 3/1992 Marra, Jr.
5,175,897 A 1/1993 Marra, Jr.
5,179,744 A 1/1993 Foster et al.
5,191,663 A 3/1993 Holder et al.
5,408,710 A 4/1995 Garman et al.
5,410,765 A 5/1995 Dicken
5,421,046 A 6/1995 Vande Streek
5,450,641 A 9/1995 Montgomery
5,455,973 A 10/1995 Brumfield et al.
5,481,772 A 1/1996 Glynn et al.
5,524,306 A 6/1996 George
5,542,135 A 8/1996 Ozrovitz et al.
5,557,817 A 9/1996 Haddock
5,642,545 A 7/1997 Howard
5,745,939 A 5/1998 Flick et al.
5,749,112 A 5/1998 Metzler
5,771,506 A 6/1998 Joiner
5,864,900 A 2/1999 Landau
5,926,873 A 7/1999 Fountain
5,987,666 A 11/1999 Zigmont
6,038,721 A * 3/2000 Gordon ..... 5/425
6,347,422 B2 * 2/2002 Heavrin ..... 5/663

* cited by examiner

SIDERAIL PAD FOR HOSPITAL BED

This application claims benefit of U.S. Provisional Application Serial No. 60/159,803, filed Oct. 15, 1999, the disclosure of which is expressly incorporated by reference herein.

BACKGROUND AND SUMMARY OF THE INVENTION

The present invention generally relates to hospital beds having patient siderails. More particularly, this invention relates to siderail pads for siderails.

A patient resting in a hospital bed may inadvertently come in physical contact with a siderail. Also, mattresses are sometimes used with bed frames of different widths. If a mattress is too small, a gap or crevice is created between an edge of the mattress and a siderail of the bed.

According to the present invention, a siderail apparatus is provided for use with a patient support, such as a bed. The patient support includes a frame, a mattress supported by the frame, and a siderail coupled to the frame for movement between a raised position and a lowered position. The mattress includes an upwardly facing patient rest surface. The siderail apparatus includes a rigid support member and a bolster. The rigid support includes a first portion configured to be coupled to the siderail to support the siderail apparatus relative to the siderail and a second portion configured to extend generally parallel to and inboard of the siderail. The bolster is coupled to the second portion of the support member and includes a portion that overlies a portion of the upwardly facing patient rest surface of the mattress.

According to another aspect of the present invention, a siderail apparatus is provided for use with a patient support. The siderail apparatus includes a rigid support member adapted to be coupled to the siderail and a bolster coupled to the rigid support member in a position overlaying a portion of the patient rest surface of the mattress.

According to another aspect of the present invention, a patient support, such as a bed, is provided. The patient support includes a frame, a mattress positioned on the frame, a siderail coupled to the frame, and a padded siderail apparatus coupled to the siderail and to the frame.

According to another aspect of the invention, a patient support is provided that includes a frame, a mattress positioned on the frame, and a siderail coupled to the bedframe and including an uppermost edge. The patient support further includes a siderail apparatus coupled to the siderail. The siderail apparatus includes a bolster having a lower surface positioned over the patient rest surface of the mattress and an upper surface positioned below the uppermost edge of the siderail.

According to another aspect of the invention, a patient support is provided that includes a frame, a mattress positioned on the frame, a siderail coupled to the frame to move between a raised position and a lowered position, and a siderail apparatus including a bolster coupled to the siderail and positioned over the patient rest surface.

According to another aspect of the invention, a patient support is provided that includes a frame, a mattress positioned on the frame, and a siderail coupled to the frame to move between a raised position and a lowered position. The siderail includes a first side facing the mattress and a second side facing away from the mattress. The patient support further includes a siderail apparatus coupled to the siderail. The siderail apparatus is positioned on the first side of the siderail when the siderail is in the raised position and the siderail apparatus is positioned on the second side of the siderail when the siderail is in the lowered position.

Additional features of the present invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
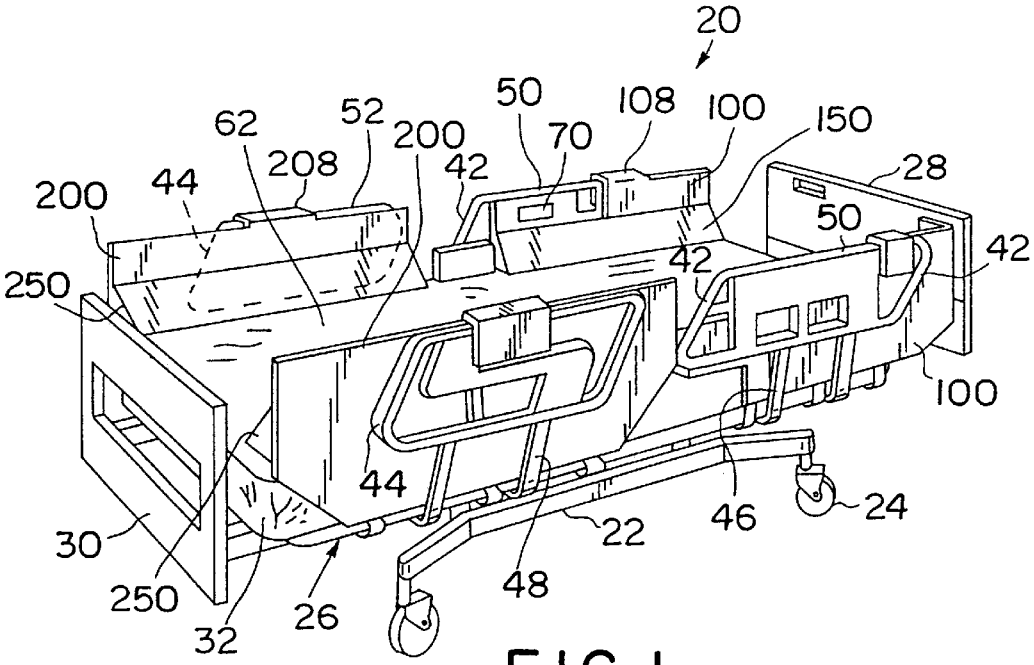
FIG. 1 is a perspective view showing a hospital bed including a base frame supported on casters, an articulating upper frame mounted on the base frame and including an upper body section, a seat section, a thigh section, and a lower leg section, a mattress supported on the articulating upper frame, a headboard, a footboard, and a pair of head-end siderails coupled to the upper body section to move between a raised patient-restraining position and a lowered storage position, and a pair of foot-end siderails coupled to the lower leg section to move between a raised patient-restraining position and a lowered storage position, and further showing two head-end siderail pads and two foot-end siderail pads in accordance with the present disclosure coupled to the respective head-end and foot-end siderails.
Figure 2:
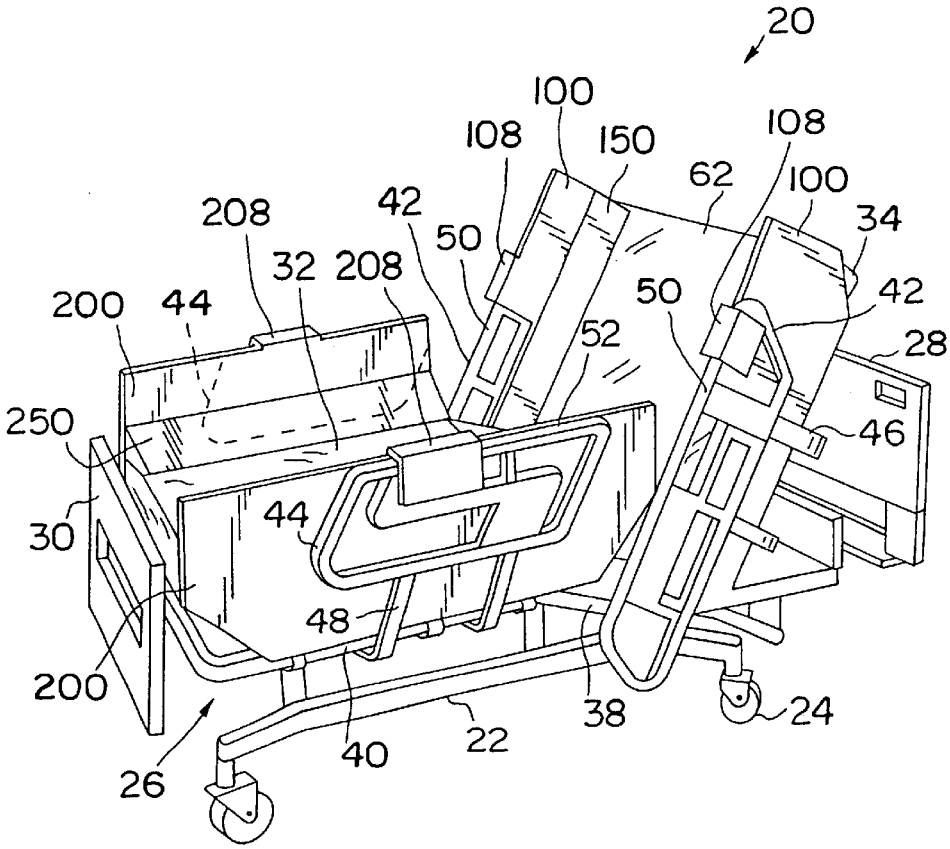
FIG. 2 is a view similar to FIG. 1 showing the upper body section of the articulating upper frame raised along with a corresponding portion of the mattress, the head-end siderails, and the head-end siderail pads, the configuration of the head-end siderail pads allowing articulation of the upper body section without interference therewith.
Figure 3:
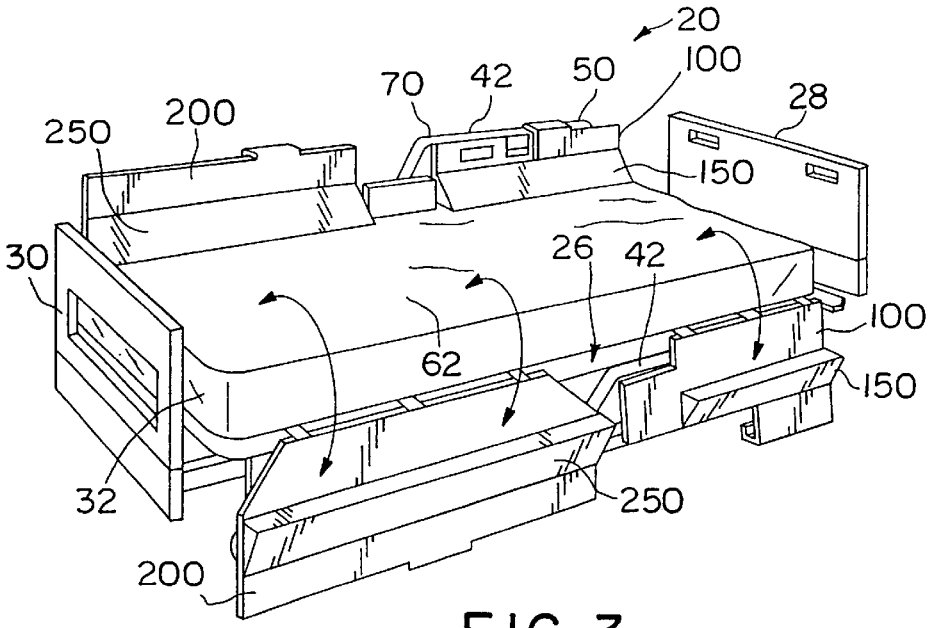
FIG. 3 is a view similar to FIG. 1 showing the siderails on one side of the bed lowered to provide access to a patient resting thereon or to facilitate patient ingress or egress, and further showing the siderail pads coupled to the siderails swung to their lowered storage position, the configuration of the head-end and foot-end siderail pads allowing lowering of one or both of the siderails without hindrance from the siderail pads.

As shown in FIGS. 1–3, a hospital bed or patient support 20 is provided that includes a bedframe 21 including a base frame 22 supported on four casters 24 on a floor and an articulating upper frame 26 (also referred to as "articulating upper deck") mounted on base frame 22. The bed 20 also includes a headboard 28, a footboard 30, and a mattress 32 supported on the articulating upper frame 26. The articulating upper frame 26 includes an upper body section 34, a seat section 36, a thigh section 38, and a lower leg section 40 that are longitudinally spaced apart and transversely extending. The upper body, thigh, and lower leg frame sections 34, 38, 40 are movable relative to the seat section 36 to provide for articulating movement thereof. Although the present invention is disclosed in the context of a bed in a hospital environment, it will be understood that it is equally applicable to a bed, stretcher, gurney, wheel chair, or other patient support, in other environments—such as a patient's home, a nursing home, a convalescent home, etc.

The articulating upper frame 26 is typically mounted on an intermediate frame (not shown), which in turn is mounted on base frame 22. A pair of head-end siderails 42 are coupled to the upper body section 34 to move between a raised patient-restraining position shown in FIGS. 1, 2, and 4 and a lowered storage position shown in FIGS. 3 and 5. A pair of foot-end siderails 44 are coupled to the lower leg section 40 to move between a raised patient-restraining position shown in FIGS. 1, 2, and 4 and a lowered storage position shown in FIGS. 3 and 5. Mechanisms 46, 48 are provided for lifting and lowering the head-end and foot-end siderails 42, 44. An illustrative articulating bed 20 of this type is disclosed in a U.S. Pat. No. 3,932,903, filed on Oct. 4, 1974, entitled "Guard Including Electrical Controls and Slidable Underneath the Bed", U.S. Pat. No. 4,025,972, filed on Oct. 16, 1975, entitled "Elevating and Trendelenburg Mechanism for an Adjustable Bed", and U.S. Pat. No. 5,878,452, filed Dec. 3, 1996, entitled "Long Term Bed Controls", the disclosures of which are expressly incorporated by reference herein.

A patient resting in the hospital bed 20 may inadvertently come in physical contact with the siderails 42, 44. To this end, as shown in FIGS. 1–3, two head-end siderail apparatus or pads 100 and two foot-end siderail apparatus or pads 200 are provided to couple to the respective head-end and foot-end siderails 42, 44. The two head-end siderail pads 100 are mirror images of each other. Thus, only the head-end siderail pad 100 closer to the viewer will be described herein in more detail with reference to FIGS. 4–6.

Figure 4:
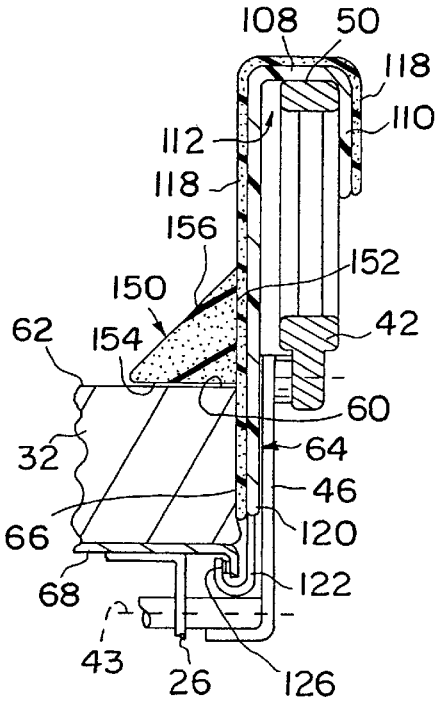
FIG. 4 is a sectional view of a portion of the hospital bed of FIGS. 1–3 showing a portion of the articulating upper frame, a portion of the mattress supported on the articulating upper frame, one of the siderails in the raised patient-restraining position, and one of the siderail pads coupled to the raised siderail and including an overhanging bolster overlying at least a portion of the mattress, the siderail pad including a lower portion extending into a gap between the siderail and the mattress, and a strap coupled to the lower edge to releasably couple the lower portion to the articulating upper frame.

The head-end siderail pad 100 includes a substantially planar support member or panel 102 made of substantially rigid material, such as hard plastic. The support member 102 includes a first portion 104 configured to be coupled to a head-end siderail 42 and a second portion 106 configured to extend generally downwardly, parallel to and inboard of (i.e., on the mattress side of) the head-end siderail 42. As shown in FIG. 4, the first portion 104 of the support member 102 includes a hook 108 that extends over a top portion or uppermost edge 50 of the head-end siderail 42 and an extension 110 that extends generally downwardly, parallel to and outboard of the head-end siderail 42. The hook 108 and the extension 110 cooperate to form a slot 112 configured to releasably receive the top portion 50 of the head-end siderail 42 and couple the head-end siderail pad 100 to siderail 42.

According to alternative embodiments of the present disclosure, other devices are provided to couple the head-end siderail pads to the siderails. For example, devices such as straps, vertically oriented hooks, latches, snaps, or other coupling devices known to those of ordinary skill in the art are provided.

The second portion 106 includes a first outer surface 114 facing toward the mattress 32 and a second inner surface 116 facing away from the mattress 32. The first surface 114 of the second portion 106 of the support member 102, exposed to the outside and likely to come in contact with a patient or an attendant, is covered with a compressible, resilient material or foam layer 118, such as soft closed-cell foam. The head-end siderail pad 100 further includes an inwardly-projecting bolster 150 coupled to the foam material 118 to couple the bolster 150 to the support member 102. Illustratively, the bolster 150 is also made from resiliently compressible material, such as soft closed-cell foam. According to alternative embodiments of the head and foot-end siderail pads, the bolster is directly coupled to the support member, the bolster and foam layer are integral, or the foam layer is not provided.

Figure 5:
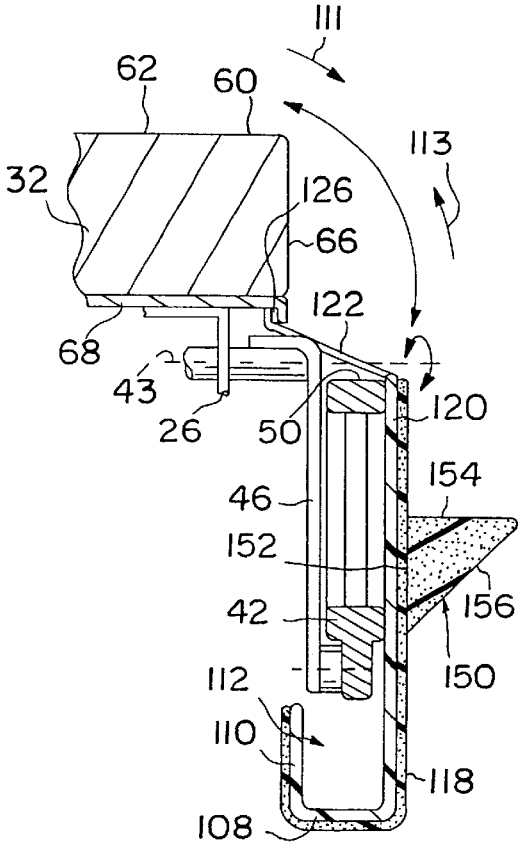
FIG. 5 is a sectional view similar to FIG. 5, with the siderail and the siderail pad shown in their respective lowered storage positions, showing the siderail pad being supported by the strap coupled to the lower edge of the siderail pad when the siderail moves to its lowered storage position.

As shown in FIGS. 4 and 5, the bolster 150 is generally triangular or wedge-shaped in cross section, and has a first parallel side 152 that extends generally parallel to the first surface 114 of the support member 102 and is configured to be coupled to the foam material 118, a second perpendicular side or lower surface 154 that extends generally perpendicularly to the first side 152 and projects over at least a portion of the mattress 32, and a third inclined side or upper surface 156 interconnecting the first and second sides 152, 154 of the bolster 150. According to alternative embodiments, other shapes of bolsters are provided. For example, rounded, square, curved, oval, concave, convex, or other shaped bolsters are provided having uniform or non-uniform cross-sections along their lengths. The head-end siderail pad 100 is dimensioned such that the second perpendicular side 154 of the bolster 150 overlies a side edge portion 60 of an upwardly-facing support or patient rest surface 62 of the mattress 32. According to alternative embodiments, the bolster either contacts or is spaced apart from the patient rest surface of the mattress.

As shown in FIG. 4, the second portion 106 of the support member 102 has a lower portion 120 that extends into a gap 64 defined by a side 66 of the mattress 32 and the mechanism 46 for lifting and lowering the head-end siderail 42. According to an alternative embodiment, the lower portion does not extend into the gap.

Figure 6:
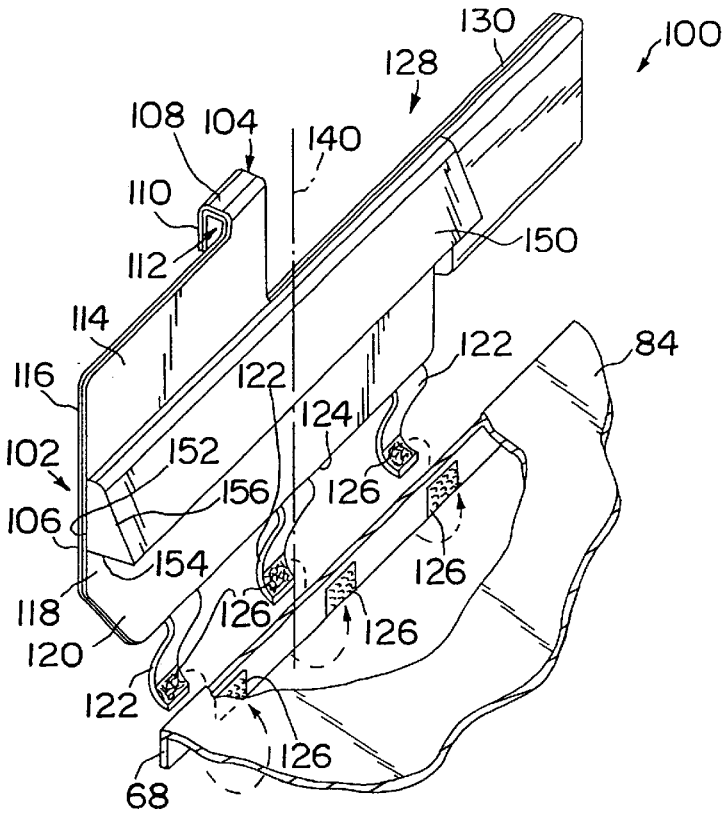
FIG. 6 is a perspective view of one of the head-end siderail pads, as viewed from the inside or the mattress side of the hospital bed, showing a plurality of straps coupled to a lower edge of the head-end siderail pad configured to releasably couple the lower edge of the head-end siderail pad to the upper body section of the articulating upper frame, the coupling of the lower edge of the head-end siderail pad to the upper body section permitting the head-end siderail pad to swing to its lowered storage position when the head-end siderail is lowered as shown in FIGS. 3 and 5.

As shown in FIGS. 4–6, a plurality of straps 122 are coupled to the lower portion 120 along its lower edge 124 to releasably couple the lower edge 124 to a frame member 68 of the upper body section 34 of the articulating upper frame 26. The straps 122 may be formed integrally with the support member 102. Alternatively, the straps 122 may be coupled to a form-fitted, wipe-down, stain-resistant protective cover (not shown) that encases the corresponding siderail pad 100. Any suitable means, such as VELCRO® brand hook-and-loop type fasteners 126, buckles (not shown), or interlocking snaps (not shown), or any other fastener known to those of ordinary skill in the art, may be employed to releasably secure the straps 124 to the frame member 68. According to alternative embodiments of the present disclosure, other devices for releasably or permanently coupling the siderail pads to the bed are provided, such as hinges, ties, snaps, links, or other coupling devices known to those of ordinary skill in the art.

The coupling of the lower edge 124 of the head-end siderail pad 100 to the frame member 68 of the upper body section 34 permits the head-end siderail pad 100 to swing to its lowered storage position when the head-end siderail 42 is lowered as shown in FIGS. 3 and 5. By virtue of the straps 122, the head-end siderail pad 100 hangs upside-down from the articulating upper deck 26 when the head-end siderail 42 is lowered to its storage position as shown in FIG. 5.

As shown in FIG. 6, the head-end siderail pad 100 is asymmetrical about its central vertical axis 140. The head-end siderail pad 100 is configured to form a window or cutout 128 for providing access to patient controls 70 mounted on the mattress side of the head-end siderail 42. The head-end siderail pad 100 may further include a portion 130 that extends toward the foot-end siderail 44 mounted on the same side of the bed 20 and overlaps a portion of the foot-end siderail pad 200. The entire siderail pad 100 may be covered with a form-fitted, wipe-down, stain-resistant protective cover (not shown), such as vinyl or nylon.

Figure 7:
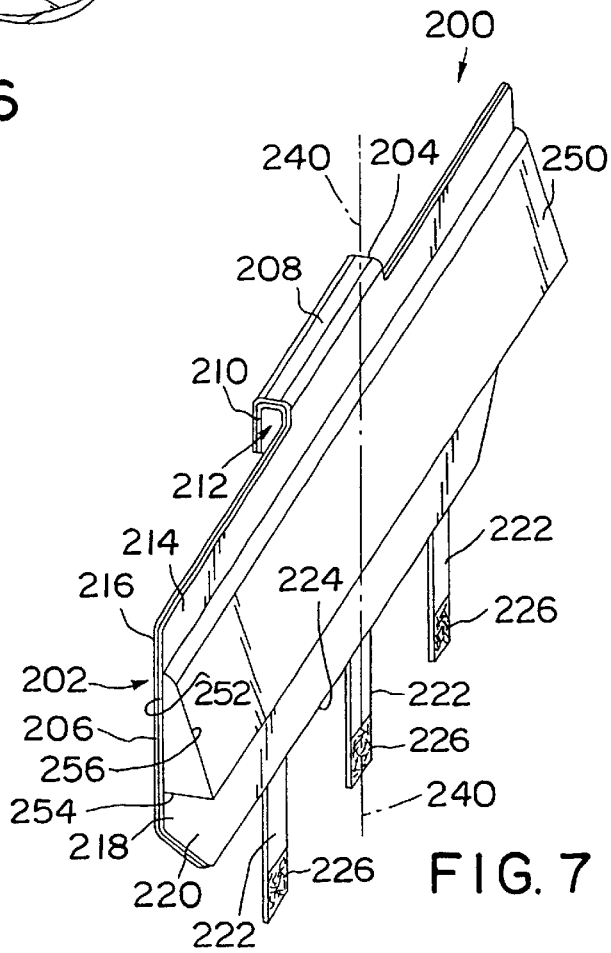
FIG. 7 is a perspective view similar to FIG. 6 of one of the foot-end siderail pads, as viewed from the mattress side, showing a plurality of straps coupled to a lower edge of the foot-end siderail pad configured to releasably couple the lower edge of the foot-end siderail pad to the lower leg section of the articulating upper frame, the coupling of the lower edge of the foot-end siderail pad to the lower leg section permitting the foot-end siderail pad to swing to its lowered storage position when the foot-end siderail is lowered as shown in FIGS. 3 and 5.

The foot-end siderail pad 200, on the other hand, is symmetrical about its central vertical axis 240 as shown in FIG. 7 so that it can be used on either side of the bed 20. The foot-end siderail pad 200 includes a substantially planar support member or panel 202 made of substantially rigid material, such as hard plastic. The support member 202 includes a first portion 204 configured to be coupled to a foot-end siderail 44 and a second portion 206 configured to extend generally downwardly, parallel to and inboard of (i.e., on the mattress side of) the foot-end siderail 44. The first portion 204 of the support member 202 includes a hook 208 that extends over a top portion 52 of the foot-end siderail 44 and an extension 210 that extends downwardly, generally parallel to and outboard of the foot-end siderail 44. The hook 208 and the extension 210 cooperate to form slot 212 configured to releasably receive the top portion or uppermost edge 52 of the foot-end siderail 44.

The second portion 206 includes a first outer surface 214 facing toward the mattress 32 and a second inner surface 216 facing away from the mattress 32. The first surface 214 of the second portion 206 of the support member 202, exposed to the outside and likely to come in contact with a patient or an attendant, is covered with a compressible, resilient material or foam layer 218, such as soft closed-cell foam. The foot-end siderail pad 200 further includes an inwardly-projecting bolster 250 coupled to the foam material 218. Illustratively, the bolster 250 is also made from resiliently compressible material, such as soft closed-cell foam.

The bolster 250 is generally triangular or wedge-shaped in cross section, and has a first parallel side 252 that extends generally parallel to the first surface 214 of the support member 202 and is coupled to the foam material 218, a second perpendicular side or lower surface 254 that extends generally perpendicularly to the first side 252 and projects over at least a portion of the mattress 32, and a third inclined side or upper surface 256 interconnecting the first and second sides 252, 254 of the bolster 250. The foot-end siderail pad 200 is dimensioned such that the second perpendicular side 254 of the bolster 250 overlies the side edge portion 60 of the upwardly-facing support surface 62 of the mattress 32.

The second portion 206 of the support member 202 has a lower portion 220 that extends into the gap 64 between the side 66 of the mattress 32 and the mechanism 48 for lifting and lowering the foot-end siderail 44. As shown in FIG. 7, a plurality of straps 222 are coupled to the lower portion 220 along its lower edge 224 for releasably securing the lower edge 224 to a frame member (not shown) of the lower leg section 40 of the articulating upper frame 26. The straps 222 may be formed integrally with the support member 202. Alternatively, the straps 222 may be coupled to a form-fitted, wipe-down, stain-resistant protective cover (not shown) that encases the corresponding siderail pad 200. Any suitable means, such as VELCRO® brand hook-and-loop type fasteners 226, buckles (not shown), or interlocking snaps (not shown), may be employed to releasably secure the straps 224 to the frame member 68.

The coupling of the lower edge 224 of the foot-end siderail pad 200 to the frame member 68 of the lower leg section 40 permits the foot-end siderail pad 200 to swing to its lowered storage position when the foot-end siderail 44 is lowered as shown in FIGS. 3 and 5. By virtue of the straps 222, the foot-end siderail pad 200 hangs upside-down from the articulating upper deck 26 when the foot-end siderail 44 is lowered to its storage position as shown in FIG. 5. The entire siderail pad 200 may be covered with a form-fitted, wipe-down, stain-resistant protective cover (not shown), such as vinyl or nylon.

As shown in FIG. 4, when the siderail 42 is in the raised position, the hook 108 couples the remainder of the siderail pad 100 to the siderail 42. When the siderail 42 is moved to the lowered position, it "clocks" or rotates about a transverse axis 43. During initial rotation of the siderail 42, the bolster 150 blocks downward movement of the siderail pad 100 with the siderail 42. As the siderail 42 drops, the upper portion 50 of the siderail 42 drops out of the slot 112 so that the siderail pad 100 is no longer coupled to the siderail 42.

When the siderail 42 approaches the lowered position, the lower portion 120 of the siderail pad 100 is no longer trapped between the mechanism 46 and the side 66 of the mattress 32. Gravity, a caregiver, or the patient cause the siderail 100 to rotate in direction 111 to the position shown in FIG. 5. Thus, before the siderail 42 was dropped, the siderail pad 100 was positioned on the inner side of the siderail 42 and after the siderail 42 is dropped, the siderail pad 100 rotates down so that it is positioned on the outer side of the siderail 42.

To raise the siderail 42, a caregiver first flips or rotates the siderail pad 100 in direction 113 so that the lower surface 154 of the bolster 150 again overlays or rests on the patient rest surface 62. Then the siderail 42 is clocked about the transverse axis 43 to the raised position. As the head-end siderail 42 approaches the raised position, the uppermost edge 50 of the head-end siderail 42 is again positioned in the slot 112 and the siderail pad 100 is again coupled to the siderail 42. The foot-end siderail 44 is similarly lowered and raised relative to the bedframe 11 and the siderail pad 200. According to alternative embodiments, the siderail pads are used with other configurations of siderails, such as siderails that are raised and lowered about a longitudinal axis, siderails that are raised and lowered in a substantially vertical plane defined by the siderail, siderails that do not move relative to the bedframe, or any other siderails known to those or ordinary skill in the art.

Figure 8:
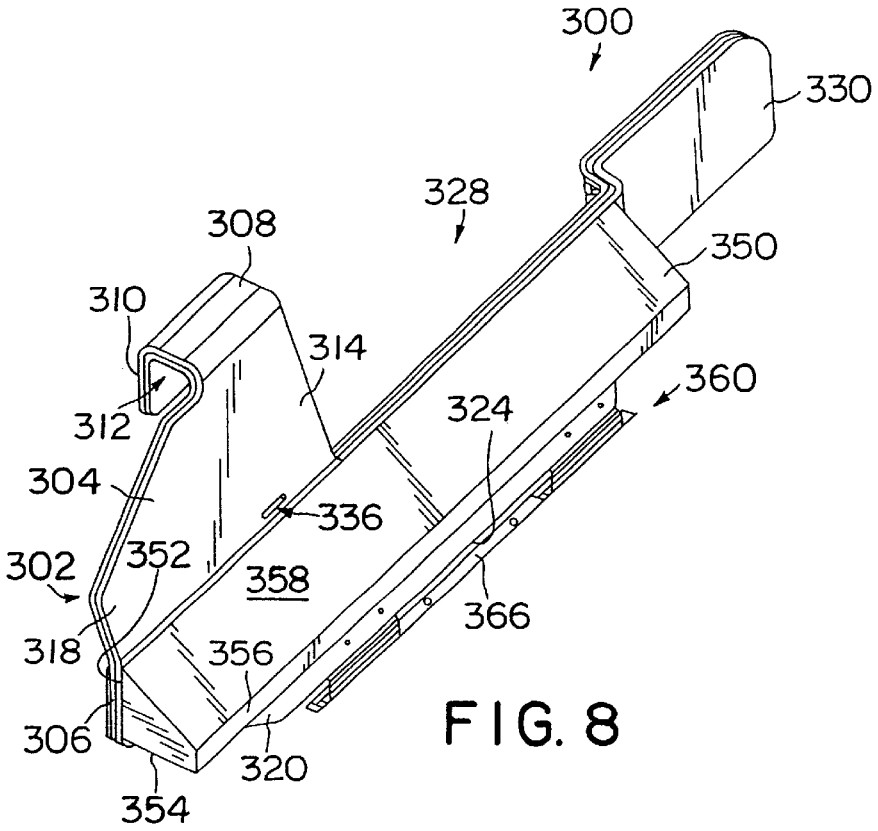
FIG. 8 is a perspective view of a second embodiment head-end siderail pad, as viewed from the mattress side, showing the pad including a plastic panel having an inclined portion configured to be coupled to a head-end siderail and an offset portion configured to be disposed toward a foot-end siderail, the offset portion facilitating articulation of the upper body section of the articulating upper frame without hindrance from the siderail pads, a foam layer coupled to the plastic panel on the mattress side thereof, a foam bolster having a truncated tip coupled to the foam layer, and a quick-release hinge assembly configured to releasably couple a lower edge of the plastic panel to a frame member of the upper body section of the articulating upper frame.
Figure 9:
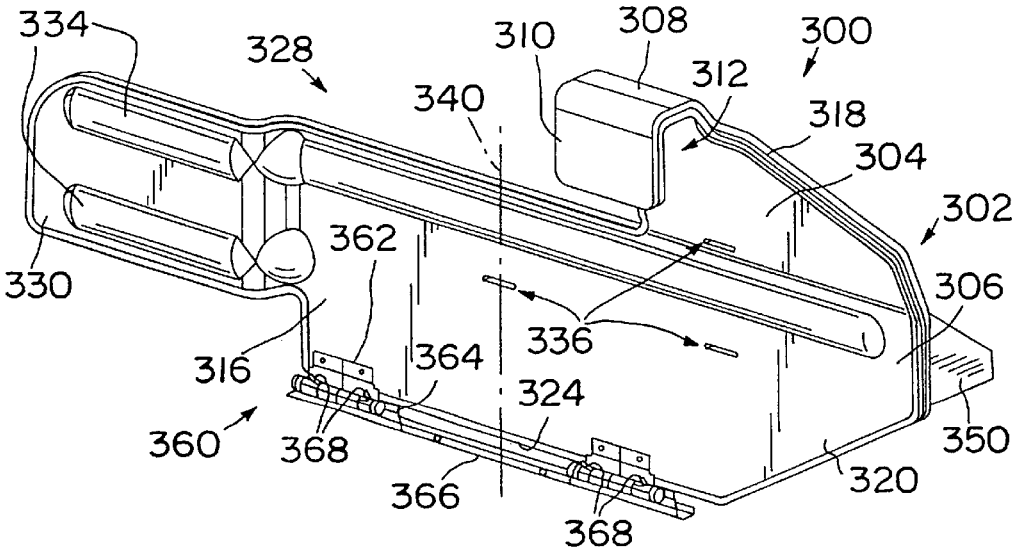
FIG. 9 is a perspective view of the head-end siderail pad of FIG. 8, as viewed from the outside, showing two generally horizontal, reinforcement ribs integrally molded therewith, the hinge assembly coupled to the lower edge of the head-end siderail pad, and a plurality of slots for receiving upholstery flaps.
Figure 10:
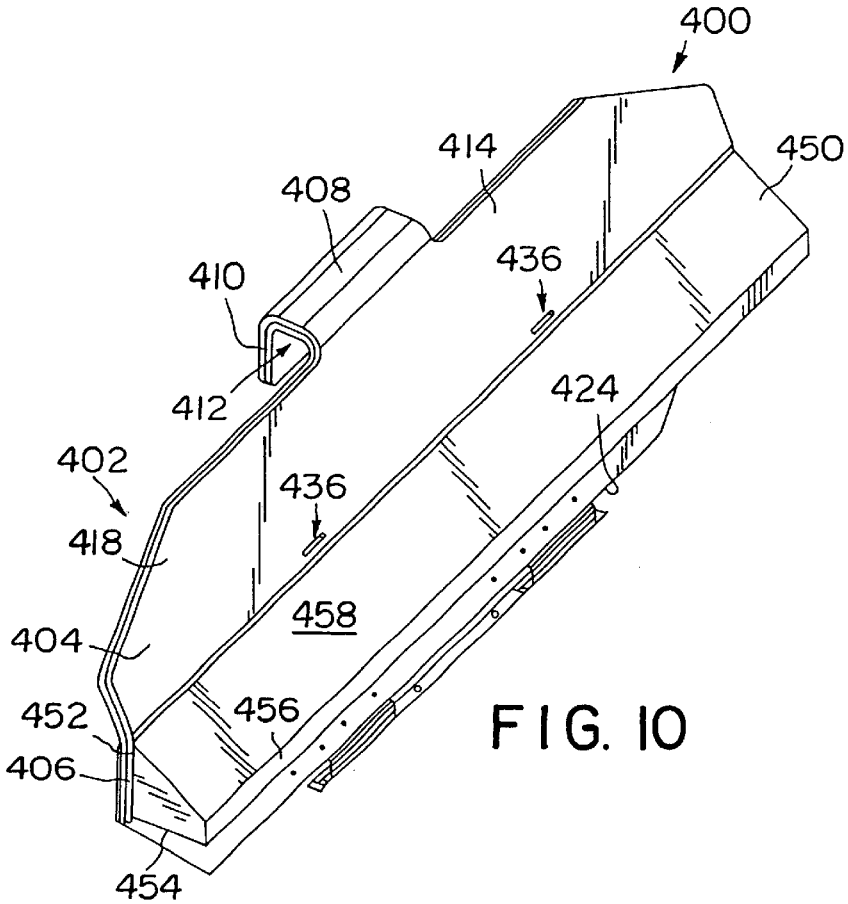
FIG. 10 is a perspective view of a second embodiment foot-end siderail pad, as viewed from the mattress side, showing the pad including a plastic panel having an inclined portion configured to be coupled to a foot-end siderail, a foam layer coupled to the plastic panel on the mattress side thereof, a foam bolster having a truncated tip coupled to the foam layer, and a quick-release hinge assembly configured to releasably couple a lower edge of the plastic panel to the lower leg section of the articulating upper frame.
Figure 11:
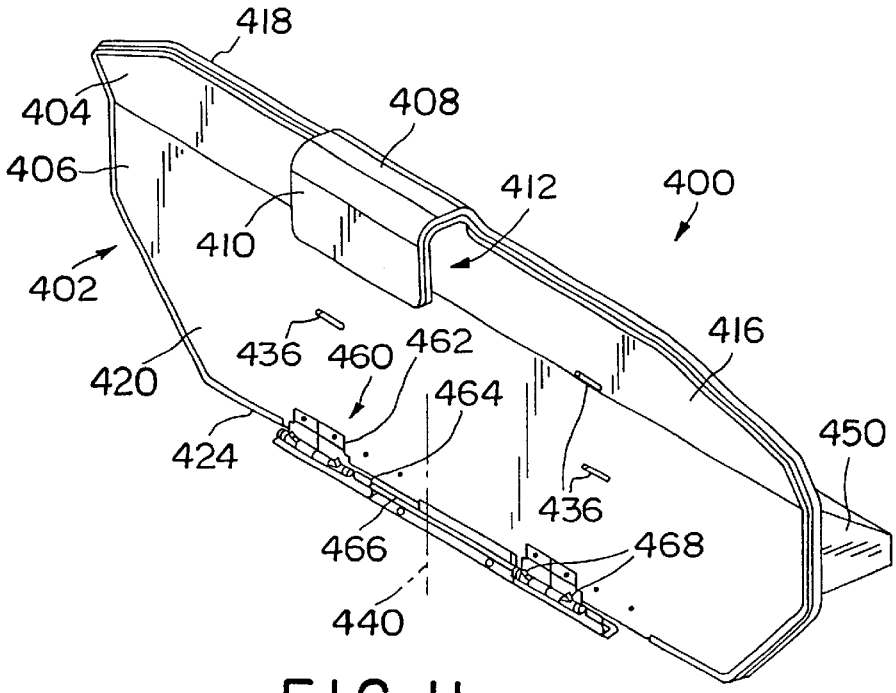
FIG. 11 is a perspective view of the foot-end siderail pad of FIG. 10, as viewed from the outside, showing a plurality of slots configured to receive upholstery flaps.

FIGS. 8 and 9 illustrate a second embodiment head-end siderail pad or apparatus 300. FIGS. 10 and 11 illustrate a second embodiment foot-end siderail pad or apparatus 400. The construction of the second embodiment of the head-end and foot-end siderail pads 300, 400 is generally similar to the construction of the first embodiments of the head-end and foot-end siderail pads 100, 200. For convenience, like components in various figures are identified by like numerals. For example, the bolster in the first embodiment of the head-end siderail pad 100 is identified by the numeral 150, while the bolster in the second embodiment of the head-end siderail pad 300 is identified by the numeral 350.

Referring to FIGS. 8 and 9, the head-end siderail pad 300 includes a support member or panel 302 made of substantially rigid material, such as hard plastic. The support member 302 includes a first inclined portion 304 configured to extend generally downwardly, at an angle to and inboard of the head-end siderail 42, and a second parallel portion 306 configured to extend generally downwardly, parallel to and inboard of the head-end siderail 42. The first inclined portion 304 is configured to be coupled to the head-end siderail 42, and.includes a hook 308 that extends over the top portion 50 of the head-end siderail 42 and an extension 310 that extends generally downwardly, parallel to and outboard of the head-end siderail 42. The hook 308 and extension 310 cooperate to form a slot 312 configured to releasably receive the top portion 50 of the head-end siderail 42.

The first inclined portion 304 and the second parallel portion 306 include a first outer surface 314 facing toward the mattress 32 and a second inner surface 316 facing away from the mattress 32. The first surface 314 of the first and second portions 304, 306 of the support member 302, exposed to the outside and likely to come in contact with a patient or an attendant, is covered with a compressible, resilient material or foam layer 318, such as soft closed-cell foam.

The head-end siderail pad 300 further includes an inwardly-projecting, truncated-tip bolster 350 coupled to the foam material 318. Illustratively, the bolster 350 is also made from resiliently compressible material, such as soft closed-cell foam.

The truncated-tip bolster 350 is generally trapezoidal or wedge-shaped in cross section, and has a first parallel side 352 that extends generally parallel to the first surface 314 of the second portion 306 of the support member 302 and is coupled to the foam material 318, a second perpendicular side or lower surface 354 that extends generally perpendicular to the first side 352 and projects over at least a portion of the mattress 32, a third truncated side or surface 356 that extends generally parallel to and spaced from the first side 352, and a fourth inclined side or upper surface 358 interconnecting the first and third sides 352, 354 of the bolster 350. The head-end siderail pad 300 is dimensioned such that the second perpendicular side 354 of the truncated-tip bolster 350 overlies the side edge portion 60 of the upwardly-facing support surface 62 of the mattress 32.

The second portion 306 of the support member 302 has a lower portion 320 that extends into the gap 64 between the side 66 of the mattress 32 and the mechanism 46 for lifting and lowering the head-end siderail 42. As shown in FIG. 9, a quick-release hinge assembly 360 is provided for releasably attaching a lower edge 324 of the support member 302 to the frame member 68 of the upper body section 34 of the articulating upper frame 26. The quick-release hinge assembly 360 includes a first hinge half 362 coupled to the lower edge 324 of the support member 302 and a second hinge half 364 coupled to an elongated strip 366. The elongated strip 366 is, in turn, coupled to the frame member 68 of the upper body section 34 of the articulating upper frame 26 by means of screws (not shown).

The configuration of the two hinge halves 362, 364 permits quick coupling and uncoupling of the head-end siderail pad 300 to the frame member 68 of the upper body section 34. The hinge assembly 360 includes two vertical posts 368 which are squeezed together to release the head-end siderail pad 300 from the frame member 68. The attachment of the lower edge 324 of the head-end siderail pad 300 to the frame member 68 of the upper body section 34 permits the head-end siderail pad 300 to swing to its lowered storage position when the head-end siderail 42 is lowered. By virtue of the hinge assembly 360, the head-end siderail pad 300 hangs upside-down from the articulating upper deck 26 when the head-end siderail 42 is lowered to its storage position.

As shown in FIGS. 8 and 9, the head-end siderail pad 300 is asymmetrical about its central vertical axis 340. The head-end siderail pad 300 is configured to form a window or cutout 328 for providing access to the patient controls 70 mounted on the mattress side of the head-end siderail 42. The head-end siderail pad 300 further includes an offset portion 330 that extends toward the foot-end siderail 44 mounted on the same side of the bed 20 and overlaps a portion of the foot-end siderail pad 400. The offset portion 330 permits articulation of the bed 20 without hindrance from the siderail pad 300. Two generally horizontal reinforcement ribs 334 are integrally molded on the side of the second portion 306 facing away from the mattress 32.

The entire siderail pad 300 may be encased in a form-fitted, wipe-down, stain-resistant protective cover (not shown), such as vinyl or nylon. A plurality of slots 336 are provided for attaching upholstery flaps (not shown) of the protective cover to aid in preventing sagging of the protective cover.

The foot-end siderail pad 400 is, on the other hand, symmetrical about its central vertical axis 440 as shown in FIGS. 10 and 11 so that it can be used on either side of the bed 20. The foot-end siderail pad 400 includes a support member or panel 402 made of substantially rigid material, such as hard plastic. The support member 402 includes a first inclined portion 404 configured to extend generally downwardly, at an angle to and inboard of the foot-end siderail 44, and a second parallel portion 406 configured to extend generally downwardly, parallel to and inboard of the foot-end siderail 44. The first inclined portion 404 is configured to be coupled to the foot-end siderail 44, and includes a hook 408 that extends over the top portion 52 of the foot-end siderail 44 and an extension 410 that extends generally downwardly, parallel to and outboard of the foot-end siderail 44. The hook 408 and extension 410 cooperate to form a slot 412 configured to releasably receive the top portion 52 of the foot-end siderail 44.

The first inclined portion 404 and the second parallel portion 406 include a first outer surface 414 facing toward the mattress 32 and a second inner surface 416 facing away from the mattress 32. The first surface 414 of the first and second portions 404, 406 of the support member 402, exposed to the outside and likely to come in contact with a patient or an attendant, is covered with a compressible, resilient material or foam layer 418, such as soft closed-cell foam.

The foot-end siderail pad 400 further includes an inwardly-projecting, truncated-tip bolster 450 coupled to the foam material 418. Illustratively, the bolster 450 is also made from resiliently compressible material, such as soft closed-cell foam. The truncated-tip bolster 450 is generally trapezoidal or wedge-shaped in cross section, and has a first parallel side 452 that extends generally parallel to the first surface 414 of the second portion 406 of the support member 402 and is coupled to the foam material 418, a second perpendicular side or lower surface 454 that extends generally perpendicular to the first side 452 and projects over at least a portion of the mattress 32, a third truncated side or surface 456 that extends generally parallel to and spaced from the first side 452, and a fourth inclined side or upper surface 458 interconnecting the first and third sides 452, 454 of the bolster 450. The foot-end siderail pad 400 is dimensioned such that the second perpendicular side 454 of the truncated-tip bolster 450 overlies the side edge portion 60 of the upwardly-facing support surface 62 of the mattress 32.

The second portion 406 of the support member 402 has a lower portion 420 that extends into the gap 64 between the side 66 of the mattress 32 and the mechanism 48 for lifting and lowering the foot-end siderail 44. As shown in FIG. 11, a quick-release hinge assembly 460 is provided to releasably couple a lower edge 424 of the support member 402 to a frame member (not shown) of the lower leg section 40 of the articulating upper frame 26. The quick-release hinge assembly 460 includes a first hinge half 462 coupled to the lower edge 424 of the support member 402 and a second hinge half 464 coupled to an elongated strip 466. The elongated strip 466 is, in turn, coupled to the frame member of the lower leg section 40 of the articulating upper frame 26 by means of screws (not shown).

The configuration of the two hinge halves 462, 464 permits quick coupling and uncoupling of the foot-end siderail pad 400 to the frame member of the lower leg section 40. The hinge assembly 460 includes two vertical posts 468 which are squeezed together to release the foot-end siderail pad 400 from the frame member. The attachment of the lower edge 424 of the foot-end siderail pad 400 to the frame member of the lower leg section 40 permits the foot-end siderail pad 400 to swing to its lowered storage position when the foot-end siderail 44 is lowered. By virtue of the hinge assembly 460, the foot-end siderail pad 400 hangs upside-down from the articulating upper deck 26 when the foot-end siderail 44 is lowered to its storage position.

The entire siderail pad 400 may be encased in a form-fitted, wipe-down, stain-resistant protective cover (not shown), such as vinyl or nylon. A plurality of slots 436 are provided for attaching upholstery flaps (not shown) of the protective cover.

Figure 12:
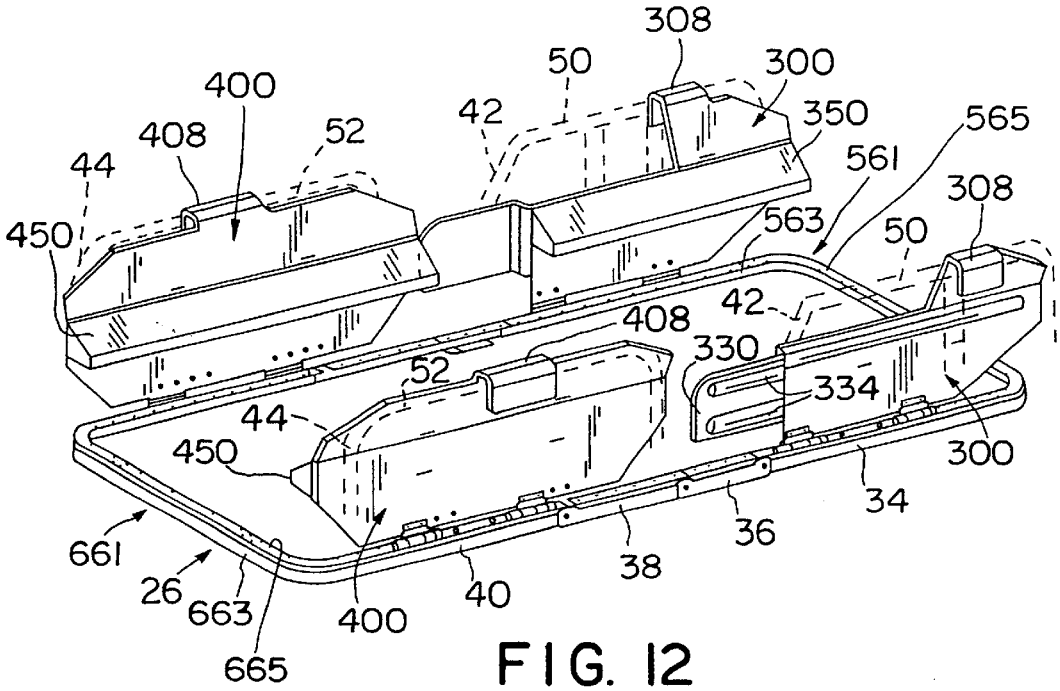
FIG. 12 is a perspective view of a hospital bed, with components removed, showing an articulating upper frame disposed in a generally horizontal position, a pair of head-end siderails (shown in phantom) movably coupled to the upper body section, a pair of foot-end siderails (shown in phantom) movably coupled to the lower leg section, a pair of head-end siderail pads of FIG. 8 coupled to the head-end siderails, and a pair of foot-end siderail pads of FIG. 10 coupled to the foot-end siderails.
Figure 13:
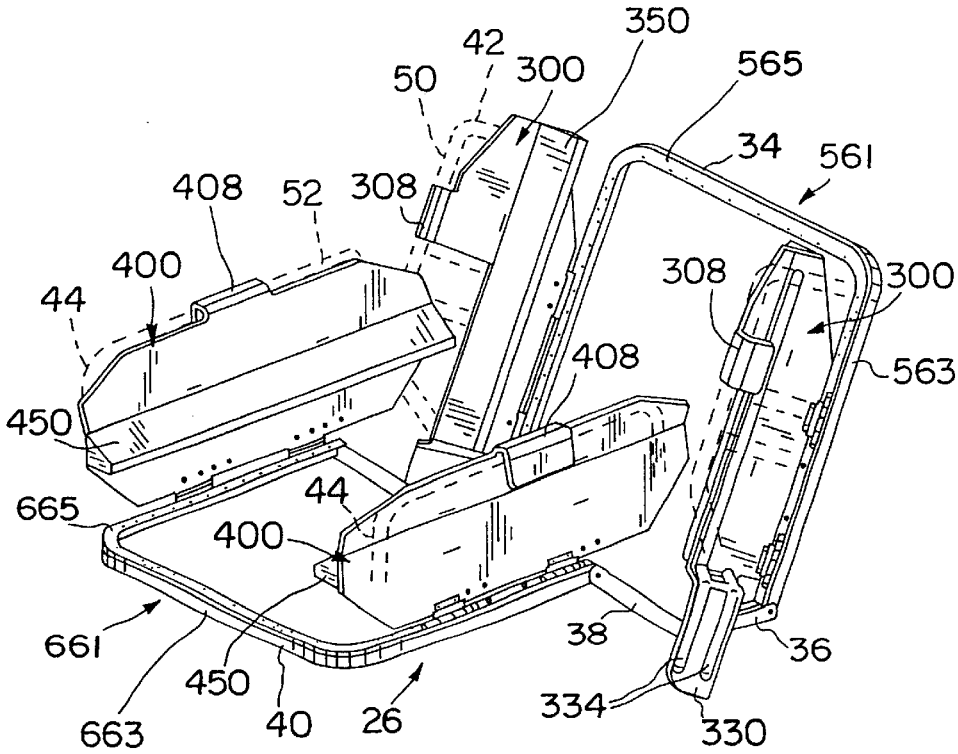
FIG. 13 is a view similar to FIG. 12 showing the upper body, thigh, and lower leg sections articulated to reconfigure the posture of a patient resting in the bed, the configuration of the siderail pads allowing articulation of the upper body, thigh, and lower leg sections without hindrance therefrom.

FIG. 12 is a perspective view showing the head-end and foot-end siderail pads 300, 400 coupled to the head-end and foot-end siderails 42, 44 while the articulating upper frame 26 is generally flat. FIG. 13 is a perspective view showing the head-end and foot-end siderail pads 300, 400 coupled to the head-end and foot-end siderails 42, 44 while the upper body, thigh, and lower leg sections 34, 38, 40 are articulated with respect to the seat section 36. The configuration of the siderail pads 300, 400 allows articulation of the bed 20 and lifting and lowering of the siderails 42 and 44 without hindrance from the siderail pads 300, 400.

Figure 14:
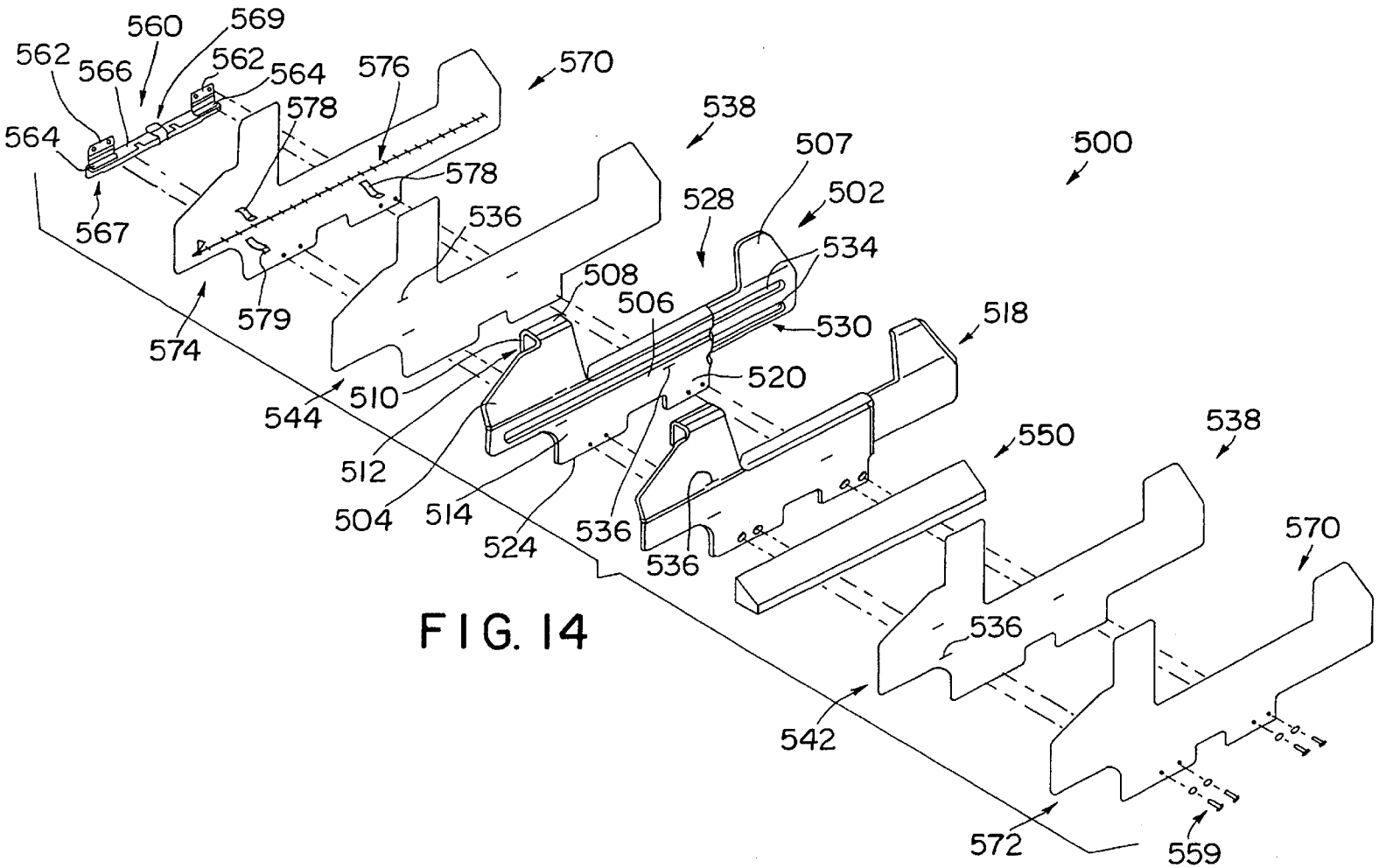
FIG. 14 is an assembly view of a third embodiment head-end siderail pad showing the pad including a plastic panel having an inclined portion configured to be coupled to a head-end siderail, a foam layer positioned to be coupled to the plastic panel on the mattress side thereof, a foam bolster having a truncated tip positioned to be coupled to the foam layer, a quick-release hinge assembly configured to releasably couple a lower edge of the plastic panel to the upper body section of the articulating upper frame, a fire-resistant sleeve having two halves positioned to cover the plastic panel, foam layer, and bolster, and a cover having two halves positioned to cover the fire-resistant sleeve.
Figure 16:
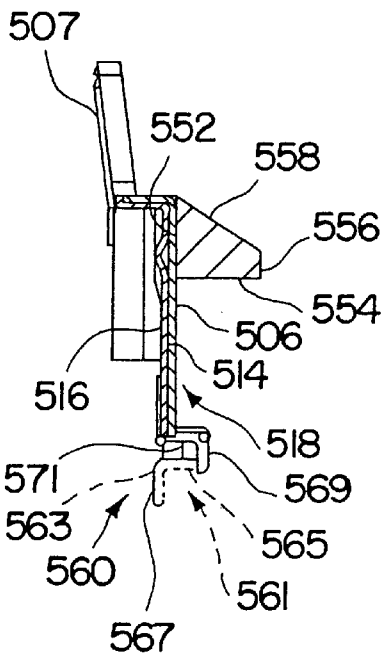
FIG. 16 is a cross-sectional view of the head-end siderail pad taken along line 16—16 of FIG. 15.
Figure 15:
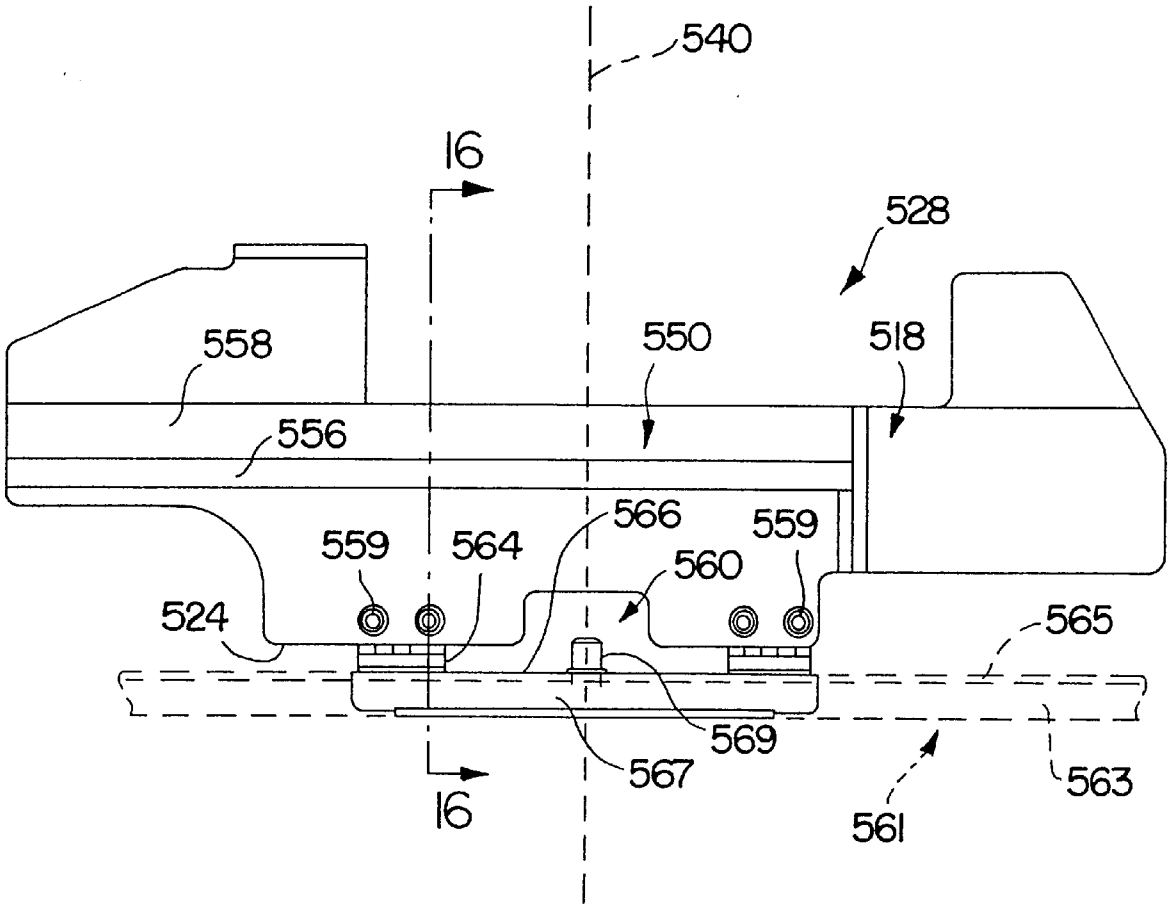
FIG. 15 is a side elevation view of the head-end siderail pad of FIG. 14, with the fire-resistant sleeve and cover removed for clarity, showing the hinge assembly coupled to frame member (in phantom)
Figure 17:
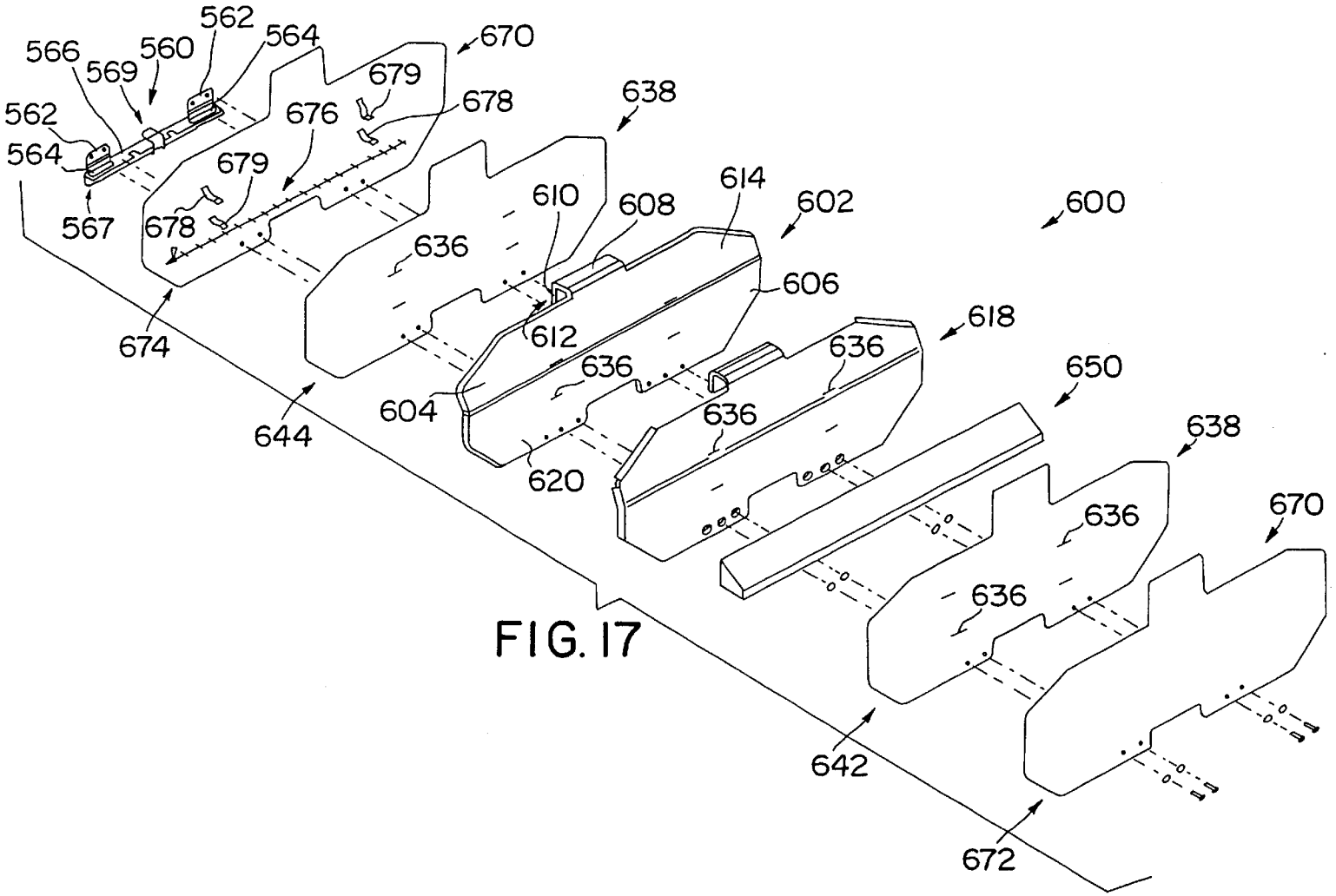
FIG. 17 is an assembly view of a third embodiment foot-end siderail pad showing the pad including a plastic panel having an inclined portion configured to be coupled to a foot-end siderail, a foam layer positioned to be coupled to the plastic panel on the mattress side thereof, a foam bolster having a truncated tip positioned to be coupled to the foam layer, a quick-release hinge assembly configured to releasably couple a lower edge of the plastic panel to the lower leg section of the articulating upper frame, a fire-resistant sleeve having two halves positioned to cover the plastic panel, foam layer, and bolster, and a cover having two halves positioned to cover the fire-resistant sleeve.
Figure 19:
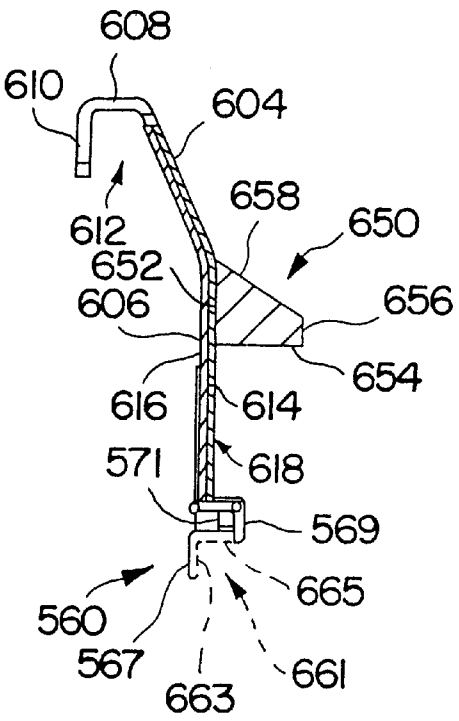
FIG. 19 is a cross-sectional view of the foot-end siderail pad taken along line 19—19 of FIG. 18.
Figure 18:
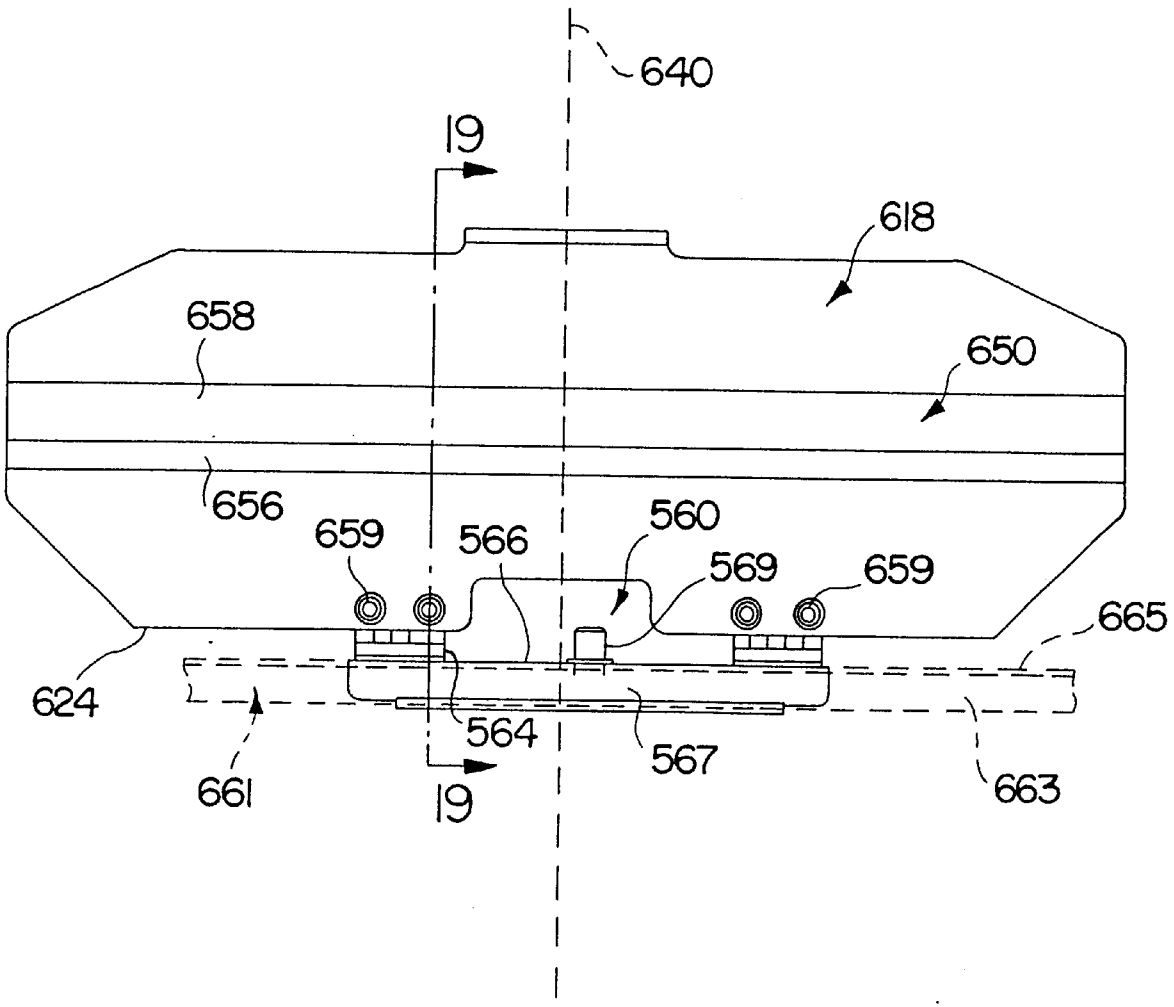
FIG. 18 is a side elevation view of the foot-end siderail pad of FIG. 17, with the fire-resistant sleeve and cover removed for clarity, showing the hinge assembly coupled to a frame member (in phantom)

FIGS. 14–16 illustrate a third embodiment head-end siderail pad or apparatus 500. FIGS. 17–19 illustrate a third embodiment foot-end siderail pad or apparatus 600. The construction of the third embodiment of the head-end and foot-end siderail pads 500, 600 is generally similar to the construction of the first embodiments of the head-end and foot-end siderail pads 100, 200. For convenience, like components in various figures are identified by like numerals. For example, the bolster in the first embodiment of the head-end siderail pad 100 is identified by the numeral 150, while the bolster in the third embodiment of the head-end siderail pad 500 is identified by the numeral 550.

Referring to FIG. 14, the head-end siderail pad 500 includes a support member or panel 502 made of substantially rigid material, such as hard plastic. The support member 502 includes a first inclined portion 504 configured to extend generally downwardly, at an angle to and inboard of the head-end siderail 42, a second parallel portion 506 configured to extend generally downwardly, parallel to and inboard of the head-end siderail 42, and a third inclined portion 507 configured to extend generally upward from the second portion 506 at an angle to and inboard of the head-end siderail 42. The first inclined portion 504 is configured to be coupled to the head-end siderail 42, and includes a hook 508 that extends over the top portion 50 of the head-end siderail 42 and an extension 510 that extends generally downwardly, parallel to and outboard of the head-end siderail 42. The hook 508 and extension 510 cooperate to form a slot 512 configured to releasably receive the top portion 50 of the head-end siderail 42.

The first inclined portion 504, the second parallel portion 506, and the third inclined portion 507 include a first outer surface 514 facing toward the mattress 32 and a second inner surface 516 facing away from the mattress 32. The first surface 514 of the first, second, and third portions 504, 506, 507 of the support member 502, exposed to the outside and likely to come in contact with a patient or an attendant, is covered with a compressible, resilient material or foam layer 518, such as soft closed-cell foam. Resilient material 518 is coupled to support member 502 by a layer of adhesive.

The head-end siderail pad 500 further includes an inwardly-projecting, truncated-tip bolster 550 coupled to the foam material 518 by a layer of spray-on adhesive. Illustratively, the bolster 550 is also made from resiliently compressible material, such as soft closed-cell foam. As shown in FIG. 16, the truncated-tip bolster 550 is generally trapezoidal or wedge-shaped in cross section, and has a first parallel side 552 that extends generally parallel to the first surface 514 of the second portion 506 of the support member 502 and is coupled to the foam material 518, a second perpendicular side or lower surface 554 that extends generally perpendicular to the first side 552 and projects over at least a portion of the mattress 32, a third truncated side or surface 556 that extends generally parallel to and spaced from the first side 552, and a fourth inclined side or upper surface 558 interconnecting the first and third sides 552, 556 of the bolster 550.

The head-end siderail pad 500 is dimensioned such that the second perpendicular side 554 of the truncated-tip bolster 550 overlies the side edge portion 60 of the upwardly-facing support surface 62 of the mattress 32. The second portion 506 of the support member 502 has a lower portion 520 that extends into the gap 64 between the side 66 of the mattress 32 and the mechanism 46 for lifting and lowering the head-end siderail 42.

The siderail pad 500 further includes a fire-resistant sleeve 538 having first and second halves 542, 544. According to a preferred method of assembling the siderail pad 500, the first and second halves 542, 544 are sewn together along the respective upper and side edges to form a pocket having an opening defined by the lower edges of the first and second halves 542, 544. The assembled support member 502, resilient material 518, and bolster 550 are then positioned in the sleeve 538 through the opening and the lower edges are sewn together using fiberglass thread to encase the support member 502, resilient material 518, and bolster 550 within the sleeve 538. The halves 542, 544 are preferably made of KEVLAR® brand fire-resistant material. According to alternative embodiments of the present disclosure, other fire-resistant or fire proof materials are used for the sleeve.

The siderail pad 500 further includes a cover 570 having first and second halves 572, 574 positioned to cover the fire-resistant sleeve 538. The halves 572, 574 are made of a wipeable, stain-resistant material such as vinyl or nylon.

According to a preferred method of assembling the siderail pad 500, the first and second halves 572, 574 are sewn together along the perimeter edges. The second half 574 includes a zipper 576 defining a slit through which the assembled sleeve 538, support member 502, resilient material 518, and bolster 550 are inserted.

The second half 574 further includes a plurality of upholstery flaps or straps 578 having hook and loop fasteners 579 thereon that are feed through a plurality of slots 536 formed in the sleeve 538, support member 502, and resilient material 518. The straps 578 are fed through buckles (not shown) coupled to the first half 572 to pull first half 572 of cover 570 and first half 542 of sleeve 538 against resilient material 518 to prevent sagging of the cover 570. According to alternative embodiments of the present disclosure, other devices for coupling the first half of the cover to the resilient material are provided such as hooks, buttons, snaps, or other fasteners.

After the fasteners 579 on the straps 578 are secured, the zipper 576 is closed to encase the assembled fire-resistant sleeve 538, support member 502, resilient material 518, and bolster 550 in the cover 570. A flap (not shown) having hook and loop fasteners is also provided to cover the pull of the zipper 576 after the zipper 576 is closed. The flap also provides an extension of the slit defined by the zipper 576 to facilitate insertion of the assembled sleeve 538, support member 502, and resilient material 518 into the cover 570.

As shown in FIG. 14, a quick-release hinge assembly 560 is provided for releasably attaching a lower edge 524 of the support member 502 to the upper body section 34 of the articulating upper frame 26. The quick-release hinge assembly 560 includes a first pair of hinge halves 562 coupled to the lower edge 524 of the support member 502 by fasteners 559 and a second pair of hinge halves 564 coupled to an elongated strip 566. The elongated strip 566 is, in turn, coupled to upper body section 34 of the articulating upper frame 26 by a hook 567 and a latch 569 pivotably coupled to the elongated strip 566 and biased by a spring 571. The latch 569 and spring 571 are configured to slide longitudinally along elongated strip 566 to permit use of the same hinge assembly 560 on each of the four head and foot-end siderail pads 500, 600.

The configuration of the hook 567 and latch 569 permits quick coupling and uncoupling of the head-end siderail pad 500 to the upper body section 34. As shown in FIGS. 12 and 13, upper body section 34 includes an L-shaped frame member 561 including a vertical portion 563 and a horizontal portion 565. To couple the hinge assembly 560 to the frame member 68, the hook 567 of elongated strip 566 is positioned around the vertical portion 563 of the frame member 561 while the latch 569 is depressed against the bias of the spring 571. After the hook 567 is positioned around the vertical portion 563 of the frame member 561, the latch 569 is released so that the latch 569 is positioned around the horizontal portion 565 of the frame member 561 to trap the frame member 561 between the hook 567 and latch 569 as shown in FIG. 16.

The attachment of the lower edge 524 of the head-end siderail pad 500 to the frame member 561 of the upper body section 34 permits the head-end siderail pad 500 to swing to its lowered storage position when the head-end siderail 42 is lowered. By virtue of the hinge assembly 560, the head-end siderail pad 500 hangs upside-down from the articulating upper deck 26 when the head-end siderail 42 is lowered to its storage position.

As shown in FIG. 15, the head-end siderail pad 500 is asymmetrical about its central vertical axis 540. The head-end siderail pad 500 is configured to form a window or cutout 528 for providing access to the patient controls 70 mounted on the mattress side of the head-end siderail 42. The head-end siderail pad 500 further includes an offset portion 530 that extends toward the foot-end siderail 44 mounted on the same side of the bed 20 and overlaps a portion of the foot-end siderail pad 600. The offset portion 530 permits articulation of the bed 20 without hindrance from the siderail pad 500. Two generally horizontal reinforcement ribs 534 are integrally molded on the side of the second portion 506 facing away from the mattress 32.

The foot-end siderail pad 600 is, on the other hand, symmetrical about its central vertical axis 640, as shown in FIG. 18, so that it can be used on either side of the bed 20.

The foot-end siderail pad 600 includes a support member or panel 602 made of substantially rigid material, such as hard plastic as shown in FIG. 17. The support member 602 includes a first inclined portion 604 configured to extend generally downwardly, at an angle to and inboard of the foot-end siderail 44, and a second parallel portion 606 configured to extend generally downwardly, parallel to and inboard of the foot-end siderail 44. The first inclined portion 604 is configured to be coupled to the foot-end siderail 44, and includes a hook 608 that extends over the top portion 52 of the foot-end siderail 44 and an extension 610 that extends generally downwardly, parallel to and outboard of the foot-end siderail 44. The hook 608 and extension 610 cooperate to form a slot 612 configured to releasably receive the top portion 52 of the foot-end siderail 44.

The first inclined portion 604 and the second parallel portion 606 include a first outer surface 614 facing toward the mattress 32 and a second inner surface 616 facing away from the mattress 32. The first surface 614 of the first and second portions 604, 606 of the support member 602, exposed to the outside and likely to come in contact with a patient or an attendant, is covered with a compressible, resilient material or foam layer 618, such as soft closed-cell foam.

The foot-end siderail pad 600 further includes an inwardly-projecting, truncated-tip bolster 650 coupled to the foam material 618. Illustratively, the bolster 650 is also made from resiliently compressible material, such as soft closed-cell foam. The truncated-tip bolster 650 is generally trapezoidal or wedge-shaped in cross section, and has a first parallel side 652 that extends generally parallel to the first surface 614 of the second portion 606 of the support member 602 and is coupled to the foam material 618, a second perpendicular side or lower surface 654 that extends generally perpendicular to the first side 652 and projects over at least a portion of the mattress 32, a third truncated side 656 that extends generally parallel to and spaced from the first side 652, and a fourth inclined side or upper surface 658 interconnecting the first and third sides 652, 654 of the bolster 650.

The foot-end siderail pad 600 is dimensioned such that the second perpendicular side 654 of the truncated-tip bolster 650 overlies the side edge portion 60 of the upwardly-facing support surface 62 of the mattress 32. The second portion 606 of the support member 602 has a lower portion 620 that extends into the gap 64 between the side 66 of the mattress 32 and the mechanism 48 for lifting and lowering the foot-end siderail 44.

The siderail pad 600 further includes a fire-resistant sleeve 638 having first and second halves 642, 644. According to a preferred method of assembling the siderail pad 600, the first and second halves 642, 644 are sewn together along the respective upper and side edges to form a pocket having an opening defined by the lower edges of the first and second halves 642, 644. The assembled support member 602, resilient material 618, and bolster 650 are then positioned in the sleeve 638 through the opening and the lower edges are sewn together using fiberglass thread to encase the support member 602, resilient material 618, and bolster 650 within the sleeve 638. The halves 642, 644 are preferably made of KEVLAR® brand fire-resistant material.

The siderail pad 600 further includes a cover 670 having first and second halves 672, 674 positioned to cover the fire-resistant sleeve 638. The halves 672, 674 are made of a wipeable, stain-resistant material such as vinyl or nylon.

According to a preferred method of assembling the siderail pad 600, the first and second halves 672, 674 are sewn together along the perimeter edges. The second half 674 includes a zipper 676 defining a slit through which the assembled sleeve 638, support member 602, resilient material 618, and bolster 650 are inserted.

The second half 674 further includes a plurality of upholstery flaps or straps 678 having hook and loop fasteners 679 thereon that are feed through a plurality of slots 636 formed in the sleeve 638, support member 602, and resilient material 618. The straps 678 are fed through buckles (not shown) coupled to the first half 672 to pull first half 672 of cover 670 and first half 642 of sleeve 638 against resilient material 618 to prevent sagging of the cover 670.

After the fasteners on the straps 678 are secured, the zipper 676 is closed to encase the assembled fire-resistant sleeve 638, support member 602, resilient material 618, and bolster 650 in the cover 670. A flap (not shown) having hook and loop fasteners is also provided to cover the pull of the zipper 676 after the zipper 676 is closed. The flap also provides an extension of the slit defined by the zipper 676 to facilitate insertion of the assembled sleeve 638, support member 602, and resilient material 618 into the cover 670.

As shown in FIG. 17, another quick-release hinge assembly 560 is provided for releasably attaching a lower edge 624 of the support member 602 to the lower leg section 40 of the articulating upper frame 26. The configuration of the hook 567 and latch 569 permits quick coupling and uncoupling of the foot-end siderail pad 600 to the lower leg section 40. As shown in FIGS. 12 and 13, lower leg section 40 includes an L-shaped frame member 661 including a vertical portion 663 and a horizontal portion 665. To couple the hinge assembly 560 to the frame member 68, the hook 567 of elongated strip 566 is positioned around the vertical portion 663 of the frame member 661 while the latch 569 is depressed against the bias of the spring 571. After the hook 567 is positioned around the vertical portion 663 of the frame member 661, the latch 569 is released so that the latch 569 is positioned around the horizontal portion 665 of the frame member 661 to trap the frame member 661 between the hook 567 and latch 569 as shown in FIG. 19.

The attachment of the lower edge 624 of the foot-end siderail pad 600 to the frame member 661 of the lower body section 40 permits the head-end siderail pad 600 to swing to its lowered storage position when the foot-end siderail 44 is lowered. By virtue of the hinge assembly 560, the foot-end siderail pad 600 hangs upside-down from the articulating upper deck 26 when the foot-end siderail 44 is lowered to its storage position.

Thus it will be seen that the siderail pads 100, 200, 300, 400, 500, 600 according to this disclosure provide soft padding 118, 218, 318, 418, 518, 618 around the siderails 42, 44 to prevent injury to a patient or a caregiver. Additionally, the bolsters 150, 250, 350, 450, 550, 650 close the gap between the siderails 42, 44 and the mattress 32 or the gap within siderails 42, 44, or between adjacent split siderails 42, 44, or between the headboard 28 or the footboard 30 and an adjoining siderail 42, 44. The outer protective covers allow easy cleaning of the siderail pads 100, 200, 300, 400, 500, 600.

Illustratively, the support members 102, 202, 302, 402, 502, 602 are molded from relatively rigid plastic, such as ABS, the foam coatings 118, 218, 318, 418, 518, 618 are made from materials such as closed-cell polyurethane foam, and the bolsters 150, 250, 350, 450, 550, 650 are made from soft foam material, such as polyurethane foam, and the outer protective covers (like that shown for head and foot-end siderail pads 500, 600) encasing the siderail pads 100, 200, 300, 400, 500, 600 are made from wipe-down, stain-resistant material, such as vinyl or nylon.

Although the invention has been described in detail with reference to certain illustrated embodiments, variations and modifications exist within the scope and spirit of the present invention as described and defined in the following claims.

What is claimed is:

1. A siderail apparatus for use with a patient support including a frame, a mattress supported by the frame, and a siderail coupled to the frame for movement between a raised position and a lowered position, the mattress having an upwardly facing patient rest surface, the siderail apparatus comprising a rigid support member having a first portion configured to be coupled to the siderail to support the rigid support member relative to the siderail and a second portion configured to extend generally parallel to and inboard of the siderail and a bolster coupled to the second portion of the support member, the bolster having a portion that overlies a portion of the upwardly facing patient rest surface of the mattress.

2. The siderail apparatus of claim 1, wherein a surface of the second portion of the support member facing toward the mattress is covered with a resilient foam material.

3. The siderail apparatus of claim 1, wherein the first portion of support member is configured to be removably coupled to the siderail.

4. The siderail apparatus of claim 1, wherein the bolster is removably coupled to the second portion of the support member.

5. The siderail apparatus of claim 1, wherein the bolster extends longitudinally along the patient rest surface of the mattress.

6. The siderail apparatus of claim 5 for use in a frame including an articulatable deck, wherein a length of the bolster is such that the deck of the bed can be articulated without interference with, or removal of, the bolster.

7. The siderail apparatus of claim 5, wherein the bolster has a length that is less than a length of the second portion of the support member.

8. The siderail apparatus of claim 1, wherein the bolster is wedge-shaped.

9. The siderail apparatus of claim 1, wherein the second portion of the support member has a lower-portion that extends into a gap defined between a side of the mattress and the siderail.

10. The siderail apparatus of claim 1, further comprising a coupling configured to couple the siderail apparatus to the frame.

11. The siderail apparatus of claim 1, wherein the first portion of the support member configured to be coupled to the siderail has a hook that extends over an upper edge of the siderail.

12. A siderail apparatus for use with a patient support including a frame, a mattress positioned on the frame and having an upwardly facing patient rest surface, and a siderail coupled to the frame, the siderail being moveable between a raised position and a lowered position, the siderail apparatus comprising a rigid support member adapted to be coupled to the siderail and a bolster coupled to the rigid support member in a position overlaying a portion of the patient rest surface of the mattress.

13. The siderail apparatus of claim 12, wherein the rigid support member includes a support panel and a hook defining a slot, the bolster is coupled to the support panel, and the slot is sized to receive an upper edge of the siderail.

14. The siderail apparatus of claim 12, wherein rigid support member includes a lower portion sized to extend into a gap defined between the mattress and the siderail.

15. The siderail apparatus of claim 12, further comprising a coupling adapted to couple the rigid support member to the frame.

16. The siderail apparatus of claim 12, wherein the rigid support member includes an inner surface positioned to face the mattress when the siderail is in a raised position and the siderail apparatus further includes a layer of resilient material covering the inner surface of the rigid support member.

17. The siderail apparatus of claim 12, wherein the bolster includes an upper surface and a lower surface configured to extend over the patient rest surface of the mattress.

18. The siderail apparatus of claim 12, wherein the bolster is wedge-shaped.

19. A patient support comprising a frame, a mattress positioned on the frame, a siderail coupled to the frame to move between a raised position and a lowered position, and a padded siderail apparatus coupled to the frame, the siderail apparatus being coupled to the siderail in the raised position and uncoupled from the siderail in the lowered position.

20. The patient support of claim 19, wherein the siderail apparatus is pivotably coupled to the frame.

21. The patient support of claim 20, wherein the siderail apparatus further includes a strap pivotably coupling the siderail apparatus to the frame.

22. The patient support of claim 20, wherein the siderail apparatus further includes a hinge pivotably coupling the siderail apparatus to the frame.

23. The patient support of claim 19, wherein the siderail apparatus includes a hook coupling the siderail apparatus to the siderail.

24. The patient support of claim 19, wherein the siderail moves between a raised position and a lowered position.

25. The patient support of claim 24, wherein the siderail includes a first side facing the mattress when the siderail is in the raised position and a second side facing away from the mattress when the siderail is in the lowered position, the siderail apparatus is positioned on the first side of the siderail when the siderail is in the raised position, and the siderail apparatus is positioned on the second side of the siderail when the siderail is in the lowered position.

26. The patient support of claim 25, wherein the siderail apparatus includes a bolster, the bolster is positioned over a patient rest surface of the mattress when the siderail is in the raised position, and the bolster is positioned on the second side of the siderail when the siderail is in the lowered position.

27. A patient support comprising a frame, a mattress positioned on the frame, the mattress having an upwardly facing patient rest surface, a siderail coupled to the frame, the siderail including an uppermost edge, and a siderail apparatus coupled to the siderail, the siderail apparatus including a bolster having a lower surface positioned over the patient rest surface of the mattress and an upper surface positioned below the uppermost edge of the siderail.

28. The patient support of claim 27, wherein the siderail apparatus further includes a rigid support member coupled to the siderail and the bolster is coupled to the rigid support member.

29. The patient support of claim 27, wherein the siderail moves between a raised position and a lowered position.

30. The patient support of claim 29, wherein the siderail pivots about a transverse axis during movement between the raised position and the lowered position.

31. The patient support of claim 27, wherein the bolster is wedge-shaped.

32. A patient support comprising a frame, a mattress positioned on the frame, the mattress including a patient rest surface, a siderail coupled to the frame to move between a raised position and a lowered position, and a siderail apparatus coupled to the siderail, the siderail apparatus including a bolster positioned to overlay the patient rest surface.

33. The patient support of claim 32, wherein the siderail apparatus further includes a rigid support member coupled to the siderail and the bolster is coupled to the rigid support member.

34. The patient support of claim 32, wherein the siderail pivots about a transverse axis during movement between the raised position and the lowered position.

35. The patient support of claim 32, wherein the siderail includes a first side facing the mattress when the siderail is in the raised position and a second side facing away from the mattress when the siderail is in the raised position, the siderail apparatus is positioned on the first side of the siderail when the siderail is in the raised position, and the siderail apparatus is positioned on the second side of the siderail when the siderail is in the lowered position.

36. The patient support of claim 35, wherein the bolster is positioned over the patient rest surface of the mattress when the siderail is in the raised position and the bolster is positioned on the second side of the siderail when the siderail is in the lowered position.

37. The patient support of claim 32, wherein the siderail apparatus is coupled to the frame.

38. A patient support comprising a frame, a mattress positioned on the frame, a siderail coupled to the frame to move between a raised position and a lowered position, the siderail having a first side facing the mattress and a second side facing away from the mattress, and a siderail apparatus coupled to the siderail, the siderail apparatus including a bolster positioned on the first side of the siderail when the siderail is in the raised position, the bolster being positioned on the second side of the siderail when the siderail is in the lowered position.

39. The patient support of claim 38, wherein the siderail apparatus is coupled to the frame.

40. The patient support of claim 39, wherein the siderail apparatus is pivotably coupled to the frame.

41. The patient support of claim 38, wherein siderail apparatus further includes a rigid support member coupled to the siderail and the bolster is coupled to the rigid support member.

42. The patient support of claim 41, wherein the rigid support member includes a panel and a hook coupled to the siderail.

43. The patient support of claim 42, wherein the hook defines a slot, the siderail includes an upper edge positioned in the slot when the siderail is in the raised position, and the upper edge of the siderail is spaced apart from the hook when the siderail is in the lowered position.

44. A patient support comprising an articulating frame having a first section and a second section configured to move relative to the first section during articulation of the articulating frame, a mattress positioned on the articulating frame, a first siderail coupled to the first section of the articulating frame, a second siderail coupled to the second section of the articulating frame, a first siderail apparatus positioned adjacent to the first siderail, the siderail apparatus including a first bolster positioned directly over the mattress, and a second siderail apparatus positioned adjacent to the second siderail, the siderail apparatus including a second bolster positioned over the mattress.

45. The patient support of claim 44, wherein the first and second bolsters are spaced apart.

46. The patient support of claim 44, wherein the first siderail apparatus is coupled to the first siderail and the second siderail apparatus is coupled to the second siderail.

47. The patient support of claim 44, wherein the first and second siderails are configured to move between raised and lowered positions.

48. The patient support of claim 44, wherein the first bolster has a length substantially equal to the length of the first siderail and the second bolster has a length that is than the length of the second siderail to provide clearance between the first and second bolsters during articulation of the articulating frame.

* * * * *